US007466301B2

(12) United States Patent
Sohn et al.

(10) Patent No.: US 7,466,301 B2
(45) Date of Patent: Dec. 16, 2008

(54) METHOD OF DRIVING A DISPLAY ADAPTIVE FOR MAKING A STABLE BRIGHTNESS OF A BACK LIGHT UNIT

(75) Inventors: Min Ho Sohn, Gwangmyung-shi (KR); Seong Ho Baik, Gwancheon-shi (KR)

(73) Assignee: LG Display Co., Ltd., Seoul (KR)

( * ) Notice: Subject to any disclaimer, the term of this patent is extended or adjusted under 35 U.S.C. 154(b) by 918 days.

(21) Appl. No.: 10/880,218

(22) Filed: Jun. 28, 2004

(65) Prior Publication Data

US 2005/0104840 A1 May 19, 2005

(30) Foreign Application Priority Data

Nov. 17, 2003 (KR) ..... 10-2003-0081174

(51) Int. Cl.
*G09G 3/36* (2006.01)

(52) U.S. Cl. ..... 345/102; 345/84

(58) Field of Classification Search ..... 345/87, 345/88, 89, 98, 99, 102, 55, 76, 84
See application file for complete search history.

(56) References Cited

U.S. PATENT DOCUMENTS

| | | | | |
|---|---|---|---|---|
| 6,756,954 | B2 * | 6/2004 | Yamamoto et al. | 345/87 |
| 7,113,163 | B2 * | 9/2006 | Nitta et al. | 345/102 |
| 2003/0222841 | A1 * | 12/2003 | Hirosue | 345/89 |
| 2004/0246275 | A1 * | 12/2004 | Yoshihara et al. | 345/690 |
| 2006/0050047 | A1 * | 3/2006 | Jin et al. | 345/102 |

FOREIGN PATENT DOCUMENTS

| | | |
|---|---|---|
| JP | 2001-027890 | 1/2001 |
| JP | 2002-031846 | 1/2002 |
| JP | 2002-202767 | 7/2002 |
| JP | 2003-036063 | 2/2003 |
| JP | 2003-345315 | 12/2003 |

OTHER PUBLICATIONS

Preliminary Notice of Reasons for Rejection for corresponding Japanese Patent Application Serial No. 2004-192074, dated Nov. 27, 2007.

* cited by examiner

*Primary Examiner*—Chanh Nguyen
*Assistant Examiner*—Pegeman Karimi
(74) *Attorney, Agent, or Firm*—Brinks Hofer Gilson & Lione

(57) ABSTRACT

A driving method and apparatus for a liquid crystal display stabilizing variations in the brightness of a back light dependent upon brightness components extracted from data to be displayed are disclosed. In the method, the brightness components of each frame are arranged into a histogram, which is divided into a plurality of brightness areas. The most-frequent value of the brightness components or the average value of the brightness components is extracted. The brightness of a back light is controlled to correspond to the brightness areas to which the extracted most-frequent value or the average value belongs. One or more particular areas within the brightness areas are selected such that if the extracted most-frequent value or the average value belongs to the particular areas, the brightness of the back light may not be changed in successive frames.

26 Claims, 10 Drawing Sheets

METHOD OF DRIVING A DISPLAY ADAPTIVE FOR MAKING A STABLE BRIGHTNESS OF A BACK LIGHT UNIT

This application claims the benefit of Korean Patent Application No. P2003-81174 filed in Korea on Nov. 17, 2003, which is hereby incorporated by reference.

BACKGROUND OF THE INVENTION

1. Field of the Invention

This invention relates to a liquid crystal display, and more particularly to a driving method and apparatus for a liquid crystal display that is adaptive for making a stable brightness variation of a back light in correspondence with a gray level value of data.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as a monitor for a computer, office equipments, a cellular phone and the like. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. Herein, the control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V. inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom.

The inverter 16 applies a driving voltage (or driving current) for driving the back light 18 to the back light 18. The back light 18 generates light corresponding to the driving voltage (or driving current) from the inverter 16 to apply it to the liquid crystal display panel 2.

In order to display a vivid image at the liquid crystal display panel 2 driven in this manner, a distinct contrast between brightness and darkness is made in correspondence with the input data. However, since the conventional back light 18 always produces a constant degree of brightness irrespectively of the data, it is difficult to display a dynamic and fresh image.

SUMMARY OF THE INVENTION

The present invention provides a driving method and apparatus for a liquid crystal display that is adaptive stabilizing the brightness variation of a back light in correspondence with a gray level value of input data.

A method of driving a liquid crystal display according to one aspect of the present invention includes dividing gray levels in a frame into a plurality of brightness areas, converting input data into brightness components, extracting a most-frequent value and/or an average value after arranging the brightness components into a histogram of the gray levels, and controlling brightness of a back light to correspond to the brightness areas to which the extracted most-frequent value or the average value belongs.

In the method, the brightness of the back light is controlled such that a different brightness of light can be produced for each of the plurality of brightness areas.

The most-frequent value is the gray level that is occupied by the greatest number of brightness components.

The most-frequent value and/or the average value is extracted from the histogram, and the brightness of the back light is controlled to correspond to the brightness area to which the extracted value belongs.

The most-frequent value may be selected when the most-frequent value is occupied by 40% or more of the total number of brightness components and the average value extracted otherwise.

The brightness of the back light increases with an increase in the brightness area to which the extracted value belongs.

At least one of the brightness areas is an area in which a previous brightness value of the back light is maintained.

A method of driving a liquid crystal display according to another aspect of the present invention includes dividing gray levels in a frame into a plurality of brightness areas, converting input data into brightness components, extracting a most-frequent value and/or an average value after arranging the brightness components into a histogram, generating a flag signal to correspond to the brightness area to which the extracted most-frequent value or average value belongs, and controlling brightness of a back light using the extracted most-frequent value or average value and the flag signal.

In the method, the flag signal maintains a previous flag signal when the most-frequent value or the average value belongs to a particular brightness area while permitting the flag signal to change when not in the particular brightness area.

When the flag signal keeps the previous flag signal, the brightness of the back light is not changed irrespective of the area to which the most-frequent value or the average value belongs.

The particular brightness area is an area in which the brightness value of the back light is not changed.

Otherwise, when the flag signal is changed, the brightness of the back light is changed to correspond to an area at which the most-frequent value or the average value belongs.

The most-frequent value is extracted from the histogram when the most-frequent value is occupied by 40% or more of the total brightness components in the frame while the average value is extracted from the histogram otherwise.

A driving apparatus for driving a liquid crystal display according to another aspect of the present invention includes a brightness/color separator for converting data into brightness components; a histogram analyzer for arranging the brightness components into a histogram for each frame; and back light control for extracting a most-frequent value and/or an average value of the brightness components from the histogram and for controlling brightness of a back light using the extracted value. The back light control divides the brightness components into a plurality of areas and controls the brightness of the back light in correspondence with an area to which the extracted most-frequent value or average value belongs.

In the driving apparatus, the back light control includes a most-frequent and/or average value extractor for extracting the most-frequent and/or average value; a back light controller for controlling the brightness of the back light to correspond to the area at which the extracted value belongs; and a digital to analog converter for converting a digital output signal of the back light controller into an analog output signal to apply it to an inverter.

The most-frequent value may be selected when the most-frequent value is occupied by 40% or more of the total number of brightness components and the average value extracted otherwise.

The back light controller controls the back light such that a different brightness of light can be supplied for each area.

The back light control includes a most-frequent value extractor for extracting the most-frequent and/or average value; a flag generator for generating a flag signal to correspond to the area to which the extracted value belongs to; a back light controller, being supplied with the extracted value and the flag signal, for controlling the brightness of the back light to correspond to the area at which the extracted value belongs when the flag signal has been changed in comparison with the previous flag signal; and a digital to analog converter for converting a digital output signal of the back light controller into an analog output signal to apply it to an inverter.

As above, the most-frequent value may be selected when the most-frequent value is occupied by 40% or more of the total number of brightness components and the average value extracted otherwise.

The back light controller does not control the brightness of the back light when the flag signal has the same value as the previous flag signal.

The flag generator generates a flag signal identical to the previous flag signal in at least one area of the plurality of areas.

BRIEF DESCRIPTION OF THE DRAWINGS

Embodiments of the invention will be apparent from the following detailed description of the embodiments of the present invention with reference to the accompanying drawings, in which.

DETAILED DESCRIPTION OF THE PREFERRED EMBODIMENT

Figure 1:
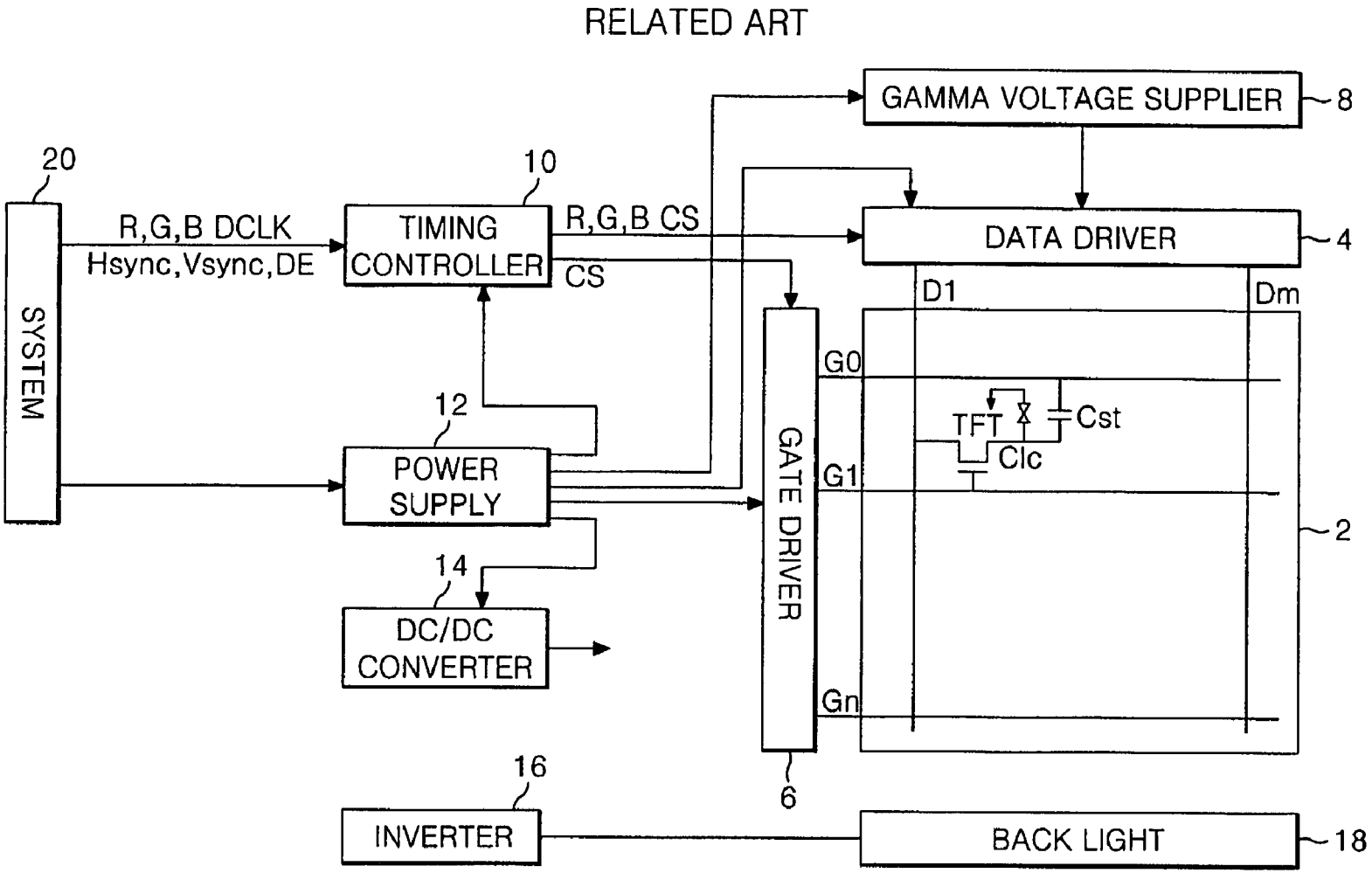
FIG. 1 RELATED ART
FIG. 1 is a schematic block diagram showing a configuration of a conventional driving apparatus for a liquid crystal display.
Figure 2:
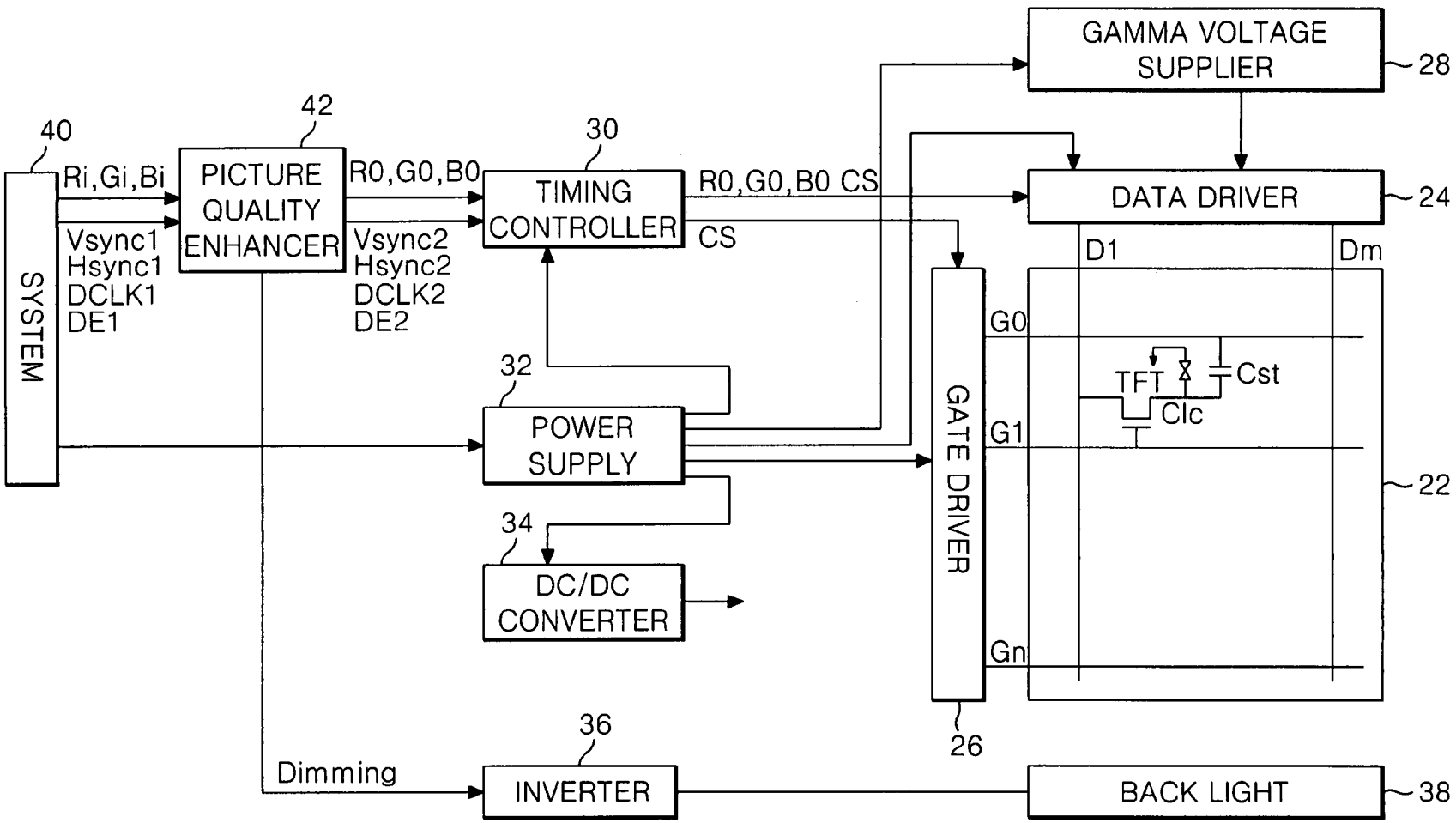
FIG. 2 is a schematic block diagram showing a configuration of a driving apparatus for a liquid crystal display according to an embodiment of the present invention.

FIG. 2 schematically shows a driving apparatus for a liquid crystal display (LCD) according to an embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter 34 for generating voltages supplied to the liquid crystal display panel 22 using a voltage from a power supply 32, an inverter 36 for driving a back light unit 38, and a picture quality enhancer 42 for selectively emphasizing a contrast of an input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal, cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data Ro, Go and Bo into analog gamma voltages (i.e., data signals) corresponding to gray level values in response to a control signal CS from the timing controller 30, and applies the analog gamma voltages to the data lines D1 to Dm.

The gate driver 26 sequentially applies a scanning pulse to the gate lines G1 to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second clock signal DCLK2 inputted from the picture quality enhancer 42. Herein, the control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply them to the data driver 24.

The DC/DC converter 34 boosts or drops a voltage of 3.3V inputted from the power supply 32 to generate a voltage supplied to the liquid crystal display panel 22. Such a DC/DC converter 34 generates a gamma reference voltage, a gate high voltage VGH, a gate low voltage VGL and a common voltage Vcom.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies light corresponding to the driving voltage (or driving current) from the inverter 36 to the liquid crystal display panel 22.

The picture quality enhancer 42 extracts brightness components using the first data Ri, Gi and Bi from the system 40, and generates second data Ro, Go and. Bo obtained by a change in gray level values of the first data Ri, Gi and Bi in correspondence with the extracted brightness components. In this case, the picture quality enhancer 42 generates the second data Ro, Go and Bo such that the contrast is selectively expanded with respect to the input data Ri, Gi and Bi.

Further, the picture quality enhancer 42 generates a brightness control signal Dimming corresponding to the brightness components to apply it to the inverter 36. For instance, the picture quality enhancer 42 extracts the most frequent value (i.e., the gray level value in the frame having the maximum number of brightness components) and/or an average value (i.e., an average value of the gray levels in the frame) from the brightness components, and generates the brightness control signal Dimming using the extracted most frequent value and/or average value. The picture quality enhancer 42 divides the brightness of the back light corresponding to gray levels of the brightness components into at least two regions, and generates the brightness control signal Dimming such that regions of the brightness are selected in correspondence with the control value.

Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
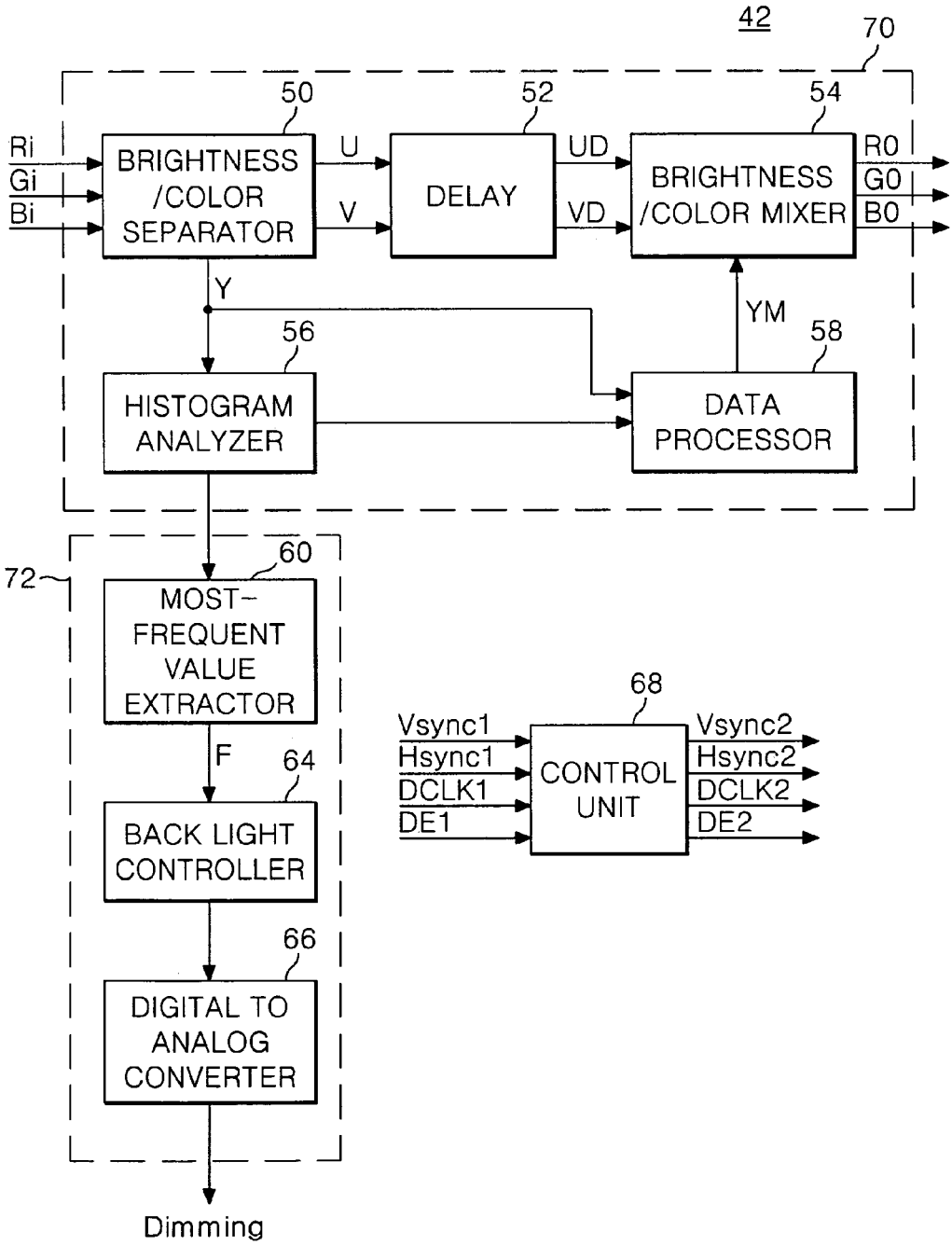
FIG. 3 is a block diagram showing a configuration of a first embodiment of the picture quality enhancer shown in FIG. 2.

To this, end, as shown in FIG. 3, the picture quality enhancer 42 includes an image signal modulator 70 for generating the second data Ro, Go and Bo using the first data Ri, Gi and Bi, a back light control 72 for generating the brightness control signal Dimming under control of the image signal modulator 70, and a control unit 68 for generating the second vertical/horizontal synchronizing signals Vsync2 and Hsync2, the second clock signal DCLK2 and the second enable signal DE2.

The image signal modulator 70 extracts the brightness components Y from the first data Ri, Gi and Bi, and generates the second data Ro, Go and Bo in which a contrast is partially emphasized with the aid of the extracted brightness components Y. To this end, the image signal modulator 70 includes a brightness/color separator 50, a delay 52, a brightness/color mixer 54, a histogram analyzer 56 and a data processor 58.

The brightness/color separator 50 separates the first data Ri, Gi and Bi into brightness components Y and chrominance components U and V. Herein, the brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

Figure 4:
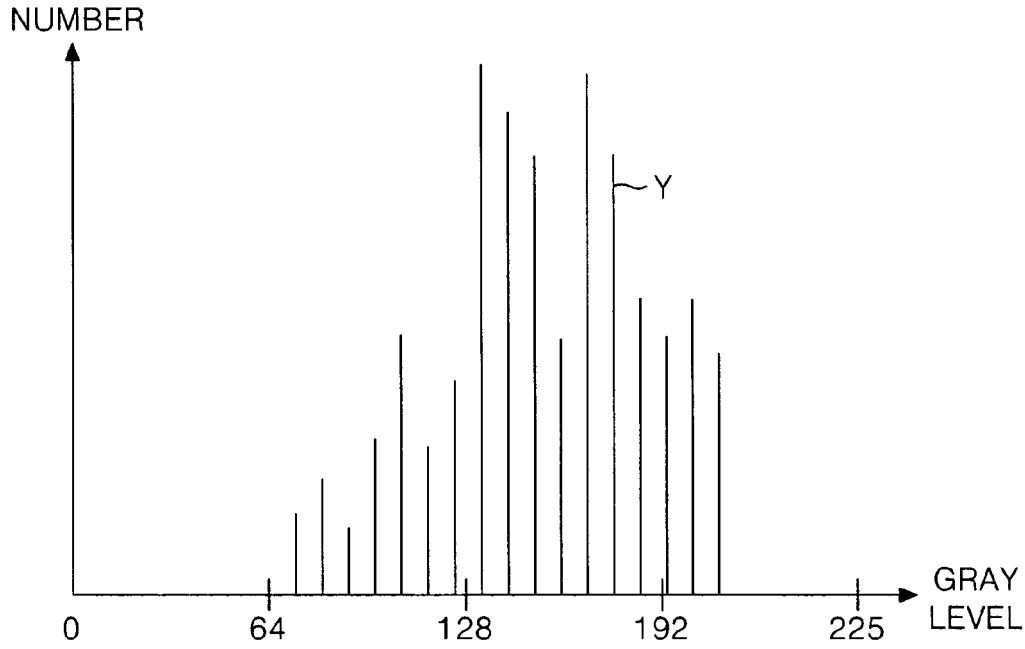
FIG. 4 illustrates a histogram analyzed by the histogram analyzer shown in FIG. 3.

The histogram analyzer 56 divides the brightness components Y into gray levels for each frame. In other words, the histogram analyzer 56 arranges the brightness components Y for each frame to correspond to the gray levels, thereby obtaining a histogram as shown in FIG. 4. The shape of the histogram thus depends on the brightness components of the first data Ri, Gi and Bi.

The data processor 58 generates modulated brightness components YM having a selectively emphasized contrast using the analyzed histogram from the histogram analyzer 56 by various methods. Such methods are disclosed in Korean Patent Applications Nos. 2003-036289, 2003-040127 and 2003-041127, etc. previously filed by the applicants and which are incorporated by reference herein.

The delay 52 delays chrominance components U and V until the brightness components YM modulated by the data processor 58 are produced. Further, the delay 52 applies the delayed chrominance components VD and UD to the brightness/color mixer 54 to be synchronized with the modulated brightness components YM.

The brightness/color mixer 54 generates second data Ro, Go and Bo with the aid of the modulated brightness components YM and the delayed chrominance components UD and VD. Herein, the second data Ro, Go and Bo is obtained by the following equations:

$$Ro=YM+0.000\times UD+1.140\times VD \quad (4)$$

$$Go=YM-0.396\times UD-0.581\times VD \quad (5)$$

$$Bo=YM+2.029\times UD+0.000\times VD \quad (6)$$

Since the second data Ro, Go and Bo obtained by the brightness/color mixer 54 has been produced from the modulated brightness components YM having an expanded contrast, they have more expanded contrast than the first data Ri, Gi and Bi. The second data Ro, Go and Bo produced such that the contrast can be expanded as mentioned above is applied to the timing controller 30.

The control unit 68 receives the first vertical/horizontal synchronizing signals Vsync1 and Hsync1, the first clock signal DCLK1 and the first data enable signal DE1 from the system 40. Further, the controller 68 generates the second vertical/horizontal synchronizing signals Vsync2 and Hsync2, the second clock signal DCLK2 and the second data enable signal DE2 in such a manner to be synchronized with the second data Ro, Go and Bo, and applies them to the timing controller 30.

The back light control 72 extracts the most-frequent value F from the histogram analyzer 56, and generates a brightness control signal Dimming using the extracted most-frequent value F.

To this end, the back light control 72 includes a most-frequent value extractor 60, a back light controller 64 and a digital to analog converter 66.

Figure 5:
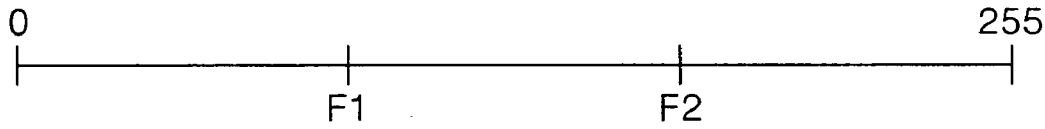
FIG. 5 illustrates an area for controlling brightness in the back light controller shown in FIG. 3.

As shown in FIG. 5, the back light controller 64 divides gray levels of the brightness components Y into a plurality of areas (e.g., three areas in FIG. 5), and controls the back light 38 such that a different brightness of light can be supplied for each area. In other words, the back light controller 64 generates a brightness control signal Dimming such that light of a low brightness is generated when the most-frequent value F is in less than a first value F1. The back light controller 64 generates a brightness control signal Dimming such that light of a middle brightness is generated when the most-frequent value F is between the first value F1 and a second value F2. The back light controller 64 generates a brightness control signal Dimming such that light of a high brightness is generated when the most-frequent value F is beyond the second value F2.

The most-frequent value extractor 60 extracts the most-frequent value F from the histogram analyzer 56 to apply it to the back light controller 64.

The digital to analog converter 66 converts a digital control signal into an analog control signal (i.e., a brightness control signal) Dimming to apply it to the inverter 36.

An operation procedure of the back light control 72 will be described in detail below.

First, the most-frequent value extractor 60 extracts a most-frequent value F from a histogram analyzed by the histogram analyzer 56 to apply it to the back light controller 64. The back light controller 64 having received the most-frequent value F checks the area (i.e., gray level value) to which the most-frequent value F applied thereto belongs. In other words, the back light controller 64 checks the area to which the most-frequent value F inputted thereto belongs, of areas in FIG. 5, and generates a brightness control signal Dimming corresponding thereto.

The brightness control signal Dimming from the back light controller 64 is applied to the digital to analog converter 66. The digital to analog converter 66 converts a brightness control signal Dimming applied thereto into an analog signal to apply it to the inverter 36. The inverter 36 controls the back light 38 such that light is applied to the liquid crystal display panel 22 in correspondence with the brightness control signal Dimming. In other words, the present back light control 72 divides gray levels into a plurality of areas and applies the brightness control signal Dimming such that light having a different brightness for each area is generated in correspondence with the most-frequent value F, thereby displaying a vivid image. That is to say, brightness of a light is controlled in accordance with the area to which the most-frequent value F belongs, thereby displaying a picture having a distinct contrast on the liquid crystal display panel 22.

However, in such an embodiment, the brightness of the back light 38 is sensitive to the most-frequent value F, which may cause sparkling. For instance, if the most-frequent value F moves between an area of middle brightness (F1<F<F2) and an area of low brightness (F<F1) and back again in adjacent frames, then the brightness of the back light 38 is changed dramatically in the adjacent frames. This is problematic if there is only a slight change in the brightness between frames but the most-frequent value F happens to fall close to the border between areas so that this slight change in the brightness is intensified by the change in the brightness of the back light 38 being supplied. Changing back and forth between two adjacent areas in successive frames causes sparkling in the liquid crystal display panel 22.

Figure 6:
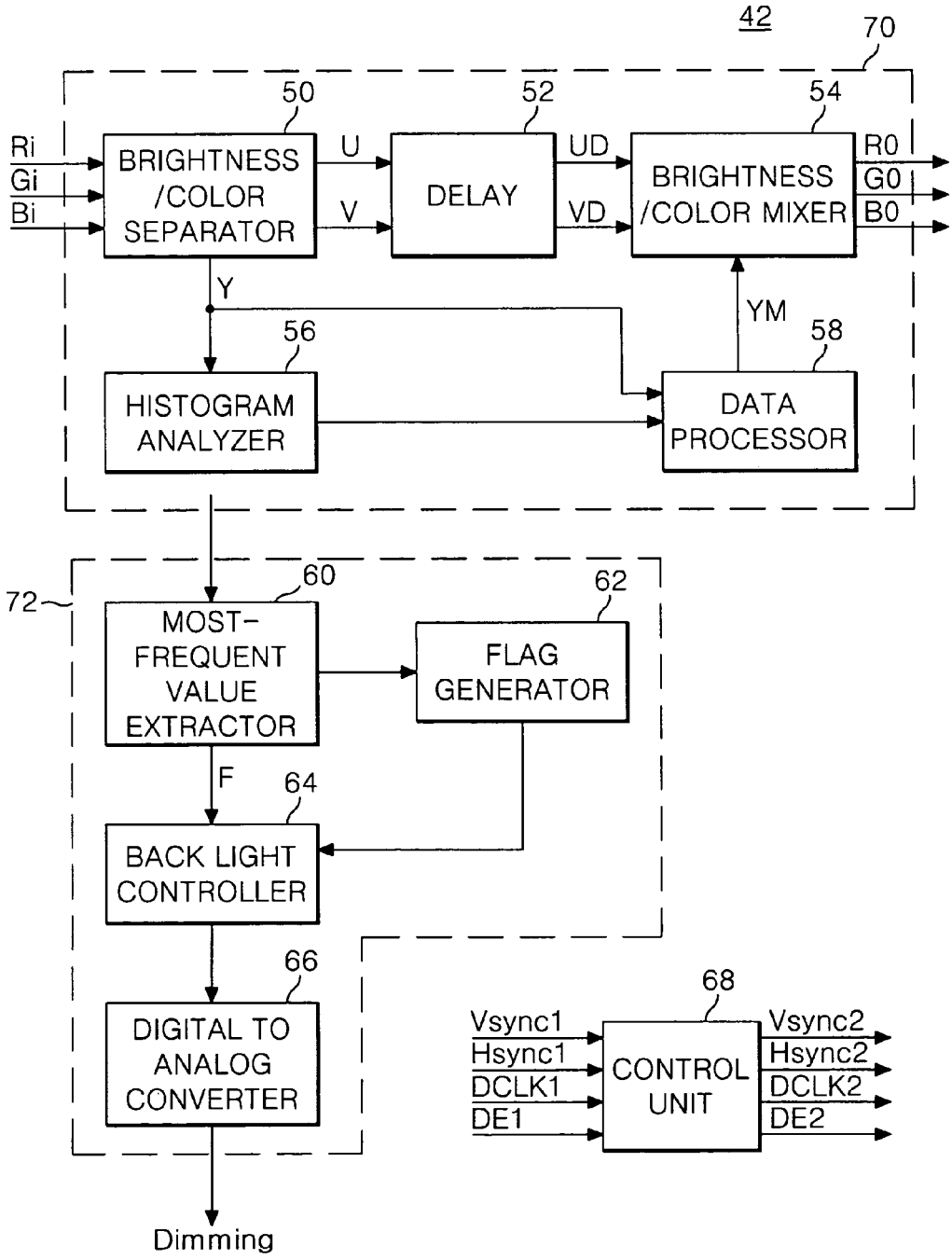
FIG. 6 is a block diagram showing a configuration of a second embodiment of the picture quality enhancer shown in FIG. 2.

In order to overcome such a problem, a picture quality enhancer according another embodiment of the present invention is shown in FIG. 6. Since configurations and functions of an image signal modulator 70 and a control unit 68 except for a back light control 72 in the embodiment of the present invention shown in FIG. 6 are identical to those of the embodiment of the present invention shown in FIG. 3, a detailed explanation as to these elements will be omitted.

Figure 7:
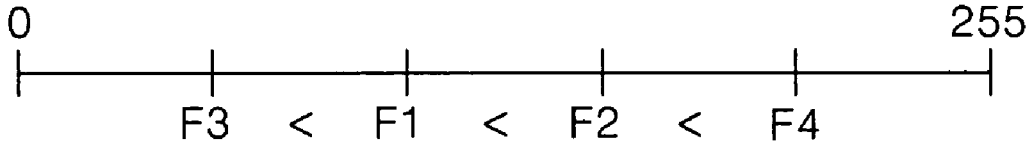
FIG. 7 illustrates an area for controlling brightness in the back light controller shown in FIG. 6.

Referring to FIG. 6, the back light control 72 according to another embodiment of the present invention extracts a most-frequent value F from the histogram analyzer 56, and generates a brightness control signal Dimming using the extracted most-frequent value F. Further, the back light control 72 according to this embodiment divides the gray levels into a plurality of areas (e.g., five areas in FIG. 7) as shown in FIG. 7, and controls brightness of a back light 38 in correspondence with an area to which the most-frequent value F belongs. Also, the back light control 72 according to this embodiment maintains a previous brightness value (the value supplied to the back light 38 in the preceding frame) in at least one area to prevent the brightness of the back light 38 from being suddenly changed in correspondence with the most-frequent value F.

To this end, the back light control 72 includes a most-frequent value extractor 60, a flag generator 62, a back light controller 64 and a digital to analog converter 66.

The most-frequent value extractor 60 extracts a most-frequent value F from the histogram analyzer 56 to apply it to the back light controller 64 and the flag generator 62.

Figure 8:
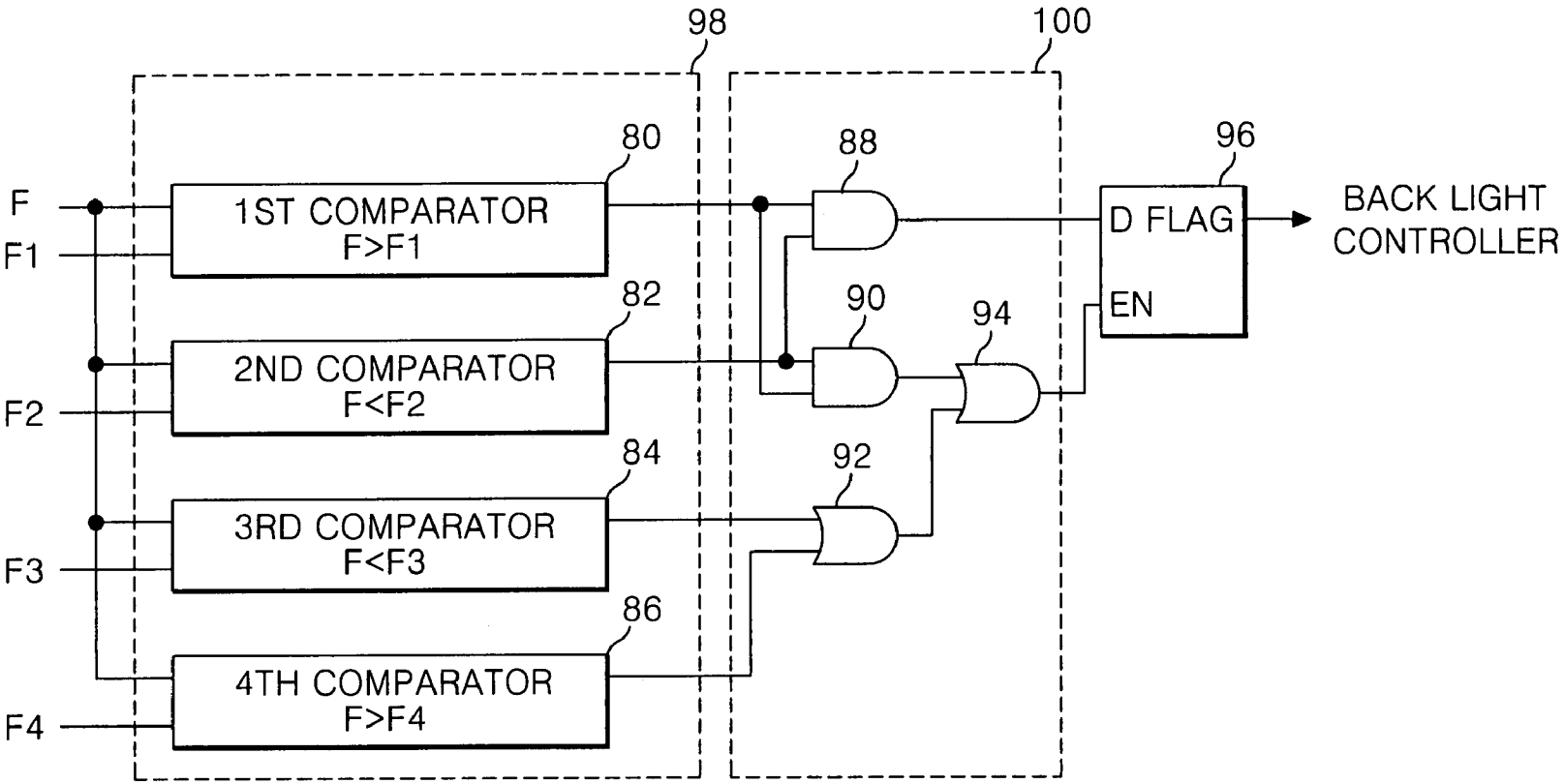
FIG. 8 is a block diagram showing a configuration of a third embodiment of the picture quality enhancer shown in FIG. 2.

The flag generator 62 applies a control signal of '0' or '1' to the back light controller 64 in correspondence with the most-frequent value F inputted thereto. An operation procedure of the flag generator 62 will be described in detail with reference to FIG. 7 and FIG. 8.

The flag generator 62 includes a comparator array 98 for comparing gray levels of boundary values F1 to F4 dividing the areas of the brightness components Y with that of the most-frequent value F, a logical sum operation array 100 logically summing the output values of the comparator array 98, and an output part 96 for generating a control signal using the output value of the logical sum operation array 100.

The comparator array 98 includes a first comparator 80 for comparing the most-frequent value F with the first boundary value F1, a second comparator 82 for comparing the most-frequent value F with the second boundary value F2, a third comparator 84 for comparing the most-frequent value F with the third boundary value F3, and a fourth comparator 86 for comparing the most-frequent value F with the fourth boundary value F2.

The first to fourth boundary values F1 to F4 are value established so as to divide gray level values into a plurality of areas. Herein, each boundary value F1 to F4 are experimentally set such that a vivid image can be displayed. For instance, the third boundary value F3 is set to a gray level value of 64; the first boundary value F1 is set to a gray level value of 96; the second boundary value F2 is set to a gray level value of 160; and the fourth boundary value F4 is set to a gray level value of 190.

Firstly, the first comparator 80 compares the most-frequent value F and the first boundary value F1 to thereby output '1' when the most-frequent value F is larger than the first boundary value F1 while outputting '0' otherwise. The second comparator 82 compares the most-frequent value F and the second boundary value F2 to thereby output '1' when the most-frequent value F is smaller than the second boundary value F2 while outputting '0' otherwise. The third comparator 84 compares the most-frequent value F and the third boundary value F3 to thereby output '1' when the most-frequent value F is smaller than the third boundary value F3 while outputting '0' otherwise. The fourth comparator 86 compares the most-frequent value F and the fourth boundary value F4 to thereby output '1' when the most-frequent value F is larger than the fourth boundary value F4 while outputting '0' otherwise.

The logical sum operation array 100 logically sums the output values to apply it to the output part 96. Herein, the logical sum operation array 100 outputs values to be applied to a clock EN and an input D of the output part 96. To this end, the logical sum operation array 100 includes first and second AND gates 88 and 90 that logically sum the output values of the first and second comparators 80 and 82, a first OR gate 92 that logically sum the output values of the third and fourth comparators 84 and 86, and a second OR gate 94 that logically sums the output values of the second AND gate 90 and the first OR gate 92. An output signal of the first AND gate 88 is applied to the input D of the output part 96. An output signal of the second OR gate 94 is applied to the clock EN of the output part 96.

The output part 96 applies a control signal (i.e., a flag signal) of '1' or '0' to the back light controller 64 in correspondence with a value from the logical sum operation array 100. To this end, the output part 96 consists of a D flip-flop. The input D of the D flip-flop receives the output signal of the first AND gate 88 while the clock EN thereof receives the output signal of the second OR gate 94.

An operation procedure of the flag generator 62 will be described assuming that the most-frequency value F is positioned between the first boundary value F1 and the second boundary value F2. If the most-frequency value F is positioned between the first boundary value F1 and the second boundary value F2, then the first and second comparators 80 and 82 output signals of '1' while the third and fourth comparators 84 and 86 output signals of '0'.

If the first and second comparators 80 and 82 output signals of '1', then the first and second AND gates 88 and 90 output signals of '0'. Herein, the signal of '1' outputted from the first AND gate 88 is applied to the input D of the output part 96. If the second AND gate 90 outputs a signal of '1', then the second OR gate 94 outputs a signal of '1' irrespectively of an output of the first OR gate 92. Herein, the signal of '1' outputted from the second OR gate 94 is applied to the clock EN of the output part 96. Thus, if the most-frequency value F is positioned between the first boundary value F1 and the second boundary value F2, then the flag generator 62 applies a flag signal of '1' to the back light controller 64.

If the most-frequent value F has a gray level less than the third boundary value F3, then the first and fourth comparators 80 and 86 output signals of '0' while the second and third comparators 82 and 84 output signals of '1'.

If the first comparator 80 outputs a signal of '0', then the first and second AND gates 88 and 90 output signals of '0' irrespectively of an output of the second comparator 82. Herein, the signal of '0' outputted from the first AND gate 88 is applied to the input D of the output part 96. If the third comparator 80 outputs a signal of '1', then the first OR gate 92 outputs a signal of '1'. On the other hand, if the first OR gate 92 outputs a signal of '1', then the second OR gate 94 also outputs a signal of '1'. Herein, the signal of '1' outputted from the second OR gate 94 is applied to the clock EN of the output part 96. Thus, the most-frequent value F has a gray level less than the third boundary value F3, then the flag generator 62 applies a flag signal of '0' to the back light controller 64.

On the other hand, if the most-frequent value F has a gray level more than the fourth boundary value F4, then the first and fourth comparators 80 and 86 output signals of '1' while the second and third comparators 82 and 84 output signals of '0'. Herein, the signal of '0' outputted from the first AND gate 88 is applied to the input D of the output part 96. If the fourth comparator 86 outputs a signal of '1', then the first OR gate 92 outputs a signal of '1'. On the other hand, if the first OR gate 92 outputs a signal of '1', then the second OR gate 94 also outputs a signal of '1'. Herein, the signal of '1' outputted from the second OR gate 94 is applied to the clock EN of the output part 96. Thus, the most-frequent value F has a gray level more than the fourth boundary value F4, then the flag generator 62 applies a flag signal of '0' to the back light controller 64.

If the most-frequent value F has a gray level between the third boundary value F3 and the first boundary value F1, then the second comparator 82 outputs a signal of '1' while the remaining comparators 80, 84 and 86 other than the second comparator 82 output signals of '0'.

If the first comparator 80 outputs a signal of '0', then the first and second AND gates 88 and 90 output signals of '0' irrespectively of an output of the second comparator 82. Herein, the signal of '0' outputted from the first AND gate 88 is applied to the input D of the output part 96. If the third and fourth comparators 84 and 86 output signals of '0', then the first and second OR gates 92 and 94 output signals of '0'. The signal of '0' outputted from the second OR gate 94 is applied to the clock EN of the output part 96. Herein, as the signal of '0' is inputted to the clock EN of the output part 96, the output part 96 does not generate an output. In other words, if the most-frequent value F has a gray level between the third boundary value F3 and the first boundary value F1, then the flag generator 62 maintains a previous flag signal (of '0' or '1')

On the other hand, if the most-frequent value F has a gray level between the second boundary value F2 and the fourth boundary value F4, then the first comparator 80 outputs a signal of '1' while the remaining comparators 82, 84 and 86 other than the first comparator 80 output signals of '0'.

If the second comparator 82 outputs a signal of '0', then the first and second AND gates 88 and 90 output signals of '0' irrespectively of an output of the first comparator 80. Herein, the signal of '0' outputted from the first AND gate 88 is applied to the input D of the output part 96. If the third and fourth comparators 84 and 86 output signals of '0', then the first and second OR gates 92 and 94 output signals of '0'. The signal of '0' outputted from the second OR gate 94 is applied to the clock EN of the output part 96. Herein, as the signal of '0' is inputted to the clock EN of the output part 96, the output part 96 does not generate an output. In other words, if the most-frequent value F has a gray level between the second boundary value F2 and the fourth boundary value F4, then the flag generator 62 maintains a previous flag signal (of '0' or '1').

In other words, the present flag generator 62 applies a flag signal of '1' to the back light controller 64 when the most-frequent value F is positioned between the first boundary value F1 and the second boundary value F2 while applying a flag signal of '0' to the back light controller 64 when the most-frequent value F has a value less than the third boundary value F3 or a value more than the fourth boundary value F4. On the other hand, the flag generator 62 maintains the previous flag signal when the most-frequent value F is positioned between the third boundary value F3 and the first boundary value F1 or between the second boundary value F2 and the fourth boundary value F4.

The back light controller 64 divides gray levels into a plurality of areas as shown in FIG. 7, and controls the back light 38 such that light having a brightness corresponding to each area can be supplied. Herein, the back slight controller 64 compares a flag value from the flag generator 62 with the previous flag value to thereby generate a brightness control signal Dimming such that light having a brightness corresponding to an area to which the most-frequent value F belongs is produced only when the flag value is changed while generating the brightness control signal Dimming such that light having the previous brightness is kept otherwise. In other words, the back light controller 64 generates a brightness control signal Dimming such that, when the most-frequent value has a value between the first boundary value F1 and the second boundary value F2, a value less than the third boundary value or a value more than the fourth boundary value F4, light corresponding thereto can be produced. On the other hand, the back light controller 64 generates a brightness control signal Dimming such that light having the previous brightness is kept when the most-frequent value F is positioned between the third boundary value F3 and the first boundary value F1 or between the second boundary value F2 and the fourth boundary value F4.

The digital to analog converter 66 converts a digital control signal into an analog control signal (i.e., a brightness control signal) Dimming to apply it to the inverter 36.

An operation procedure of the back light control 72 will be described in detail below.

First, the most-frequent value extractor 60 extracts a most-frequent value F from a histogram analyzed by the histogram analyzer 56 to apply it to the back light controller 64 and the flag generator 62. The flag generator 62 applies a flag signal corresponding to a gray level value having the most-frequent value applied thereto to the back light controller 64. Herein, the flag generator 62 sets at least one of gray level area maintaining the previous flag value, and maintains the previous flag value when the most-frequent value F is included in this area.

The back light controller 64 receives a flag signal from the flag generator 62. The back light controller 64 having received the flag signal checks whether or not the flag signal has been changed, and generates a brightness control signal to correspond to the most-frequent value F when the flag signal has been changed. On the other hand, the back light controller 64 generates a brightness control signal such that light having the previous brightness is kept irrespective of the most-frequent value F when the flag signal has not been changed (i.e., when the current flag signal is identical to the previous, flag signal).

The brightness control signal Dimming from the back light controller 64 is applied to the digital to analog converter 66. The digital to analog converter 66 converts a brightness control signal Dimming applied thereto into an analog signal to apply it to the inverter 36. Then, the inverter 36 controls the back light 38 in response to the brightness control signal Dimming, thereby applying light corresponding to the brightness control signal Dimming to the liquid crystal display panel 22.

In other words, the back light control 72 according to another embodiment of the present invention sets a plurality of gray level areas having changed brightness and applies the brightness control signal Dimming such that light having a different brightness for each area can be generated in correspondence with the most-frequent value F, thereby displaying a vivid image. That is to say, the brightness is controlled in accordance with the gray level area to which the most-frequent value F belongs, thereby displaying a picture having a distinct contrast on the liquid crystal display panel 22.

Furthermore, the back light controller according to another embodiment of the present invention generates a brightness control signal such that a gray level having the previous brightness can be displayed in at least one area of the plurality of gray level areas having changed brightness. Accordingly, brightness of the back light 38 is relatively insensitive to small changes in the most-frequent value F between frames, thereby displaying an image with a stable brightness on the liquid crystal display panel 22.

For instance, since the flag signal keeps the same value even though a gray level value having the most-frequent value F is alternates around the third boundary value F3 in FIG. 7, the back light 38 has the same brightness. In other words, in another embodiment of the present invention, a brightness control signal is generated such that a gray level having the previous brightness can be displayed in at least one area of the plurality of areas set by a division of gray levels, thereby displaying an image whose brightness is stable on the liquid crystal display panel 22.

Figure 9:
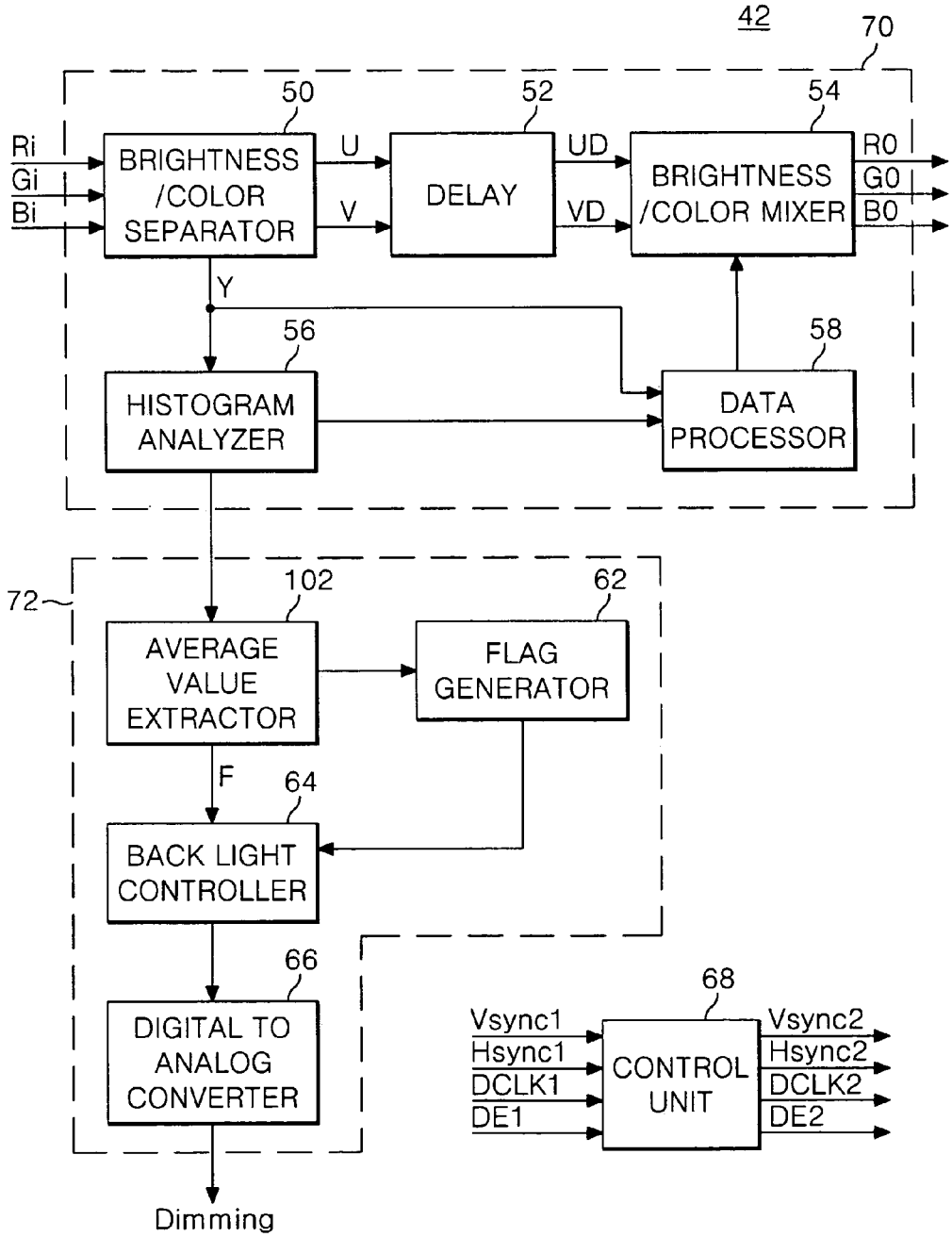
FIG. 9 is a block diagram showing a configuration of a fourth embodiment of the picture quality enhancer shown in FIG. 2.

Alternatively, in the present invention, an average value extractor 102 may be included in the back light control 72 as shown in FIG. 9. The average value extractor 102 extracts an average value of the analyzed brightness components Y from the histogram analyzer 56. In other words, the average value extractor 102 extracts an average value of the brightness components Y from the histogram analyzer 56 to apply it to the flag generator 62 and the back light controller 64. Thereafter, the flag generator 62 and the back light controller 64 generate a brightness control signal using an average value rather than the most-frequent value F. Herein, since an operation procedure of the flag generated generator 62 and the back light controller 64 has been described in detail through an explanation in FIG. 6, a detailed explanation as to these elements will be omitted. As mentioned above, the embodiment shown in FIG. 9 extracts an average value rather than the most-frequent value F from a histogram to determine brightness components Y of the data more accurately, so that it can control the brightness of the back light 38 to accurately correspond to the brightness components Y of the data.

Figure 10:
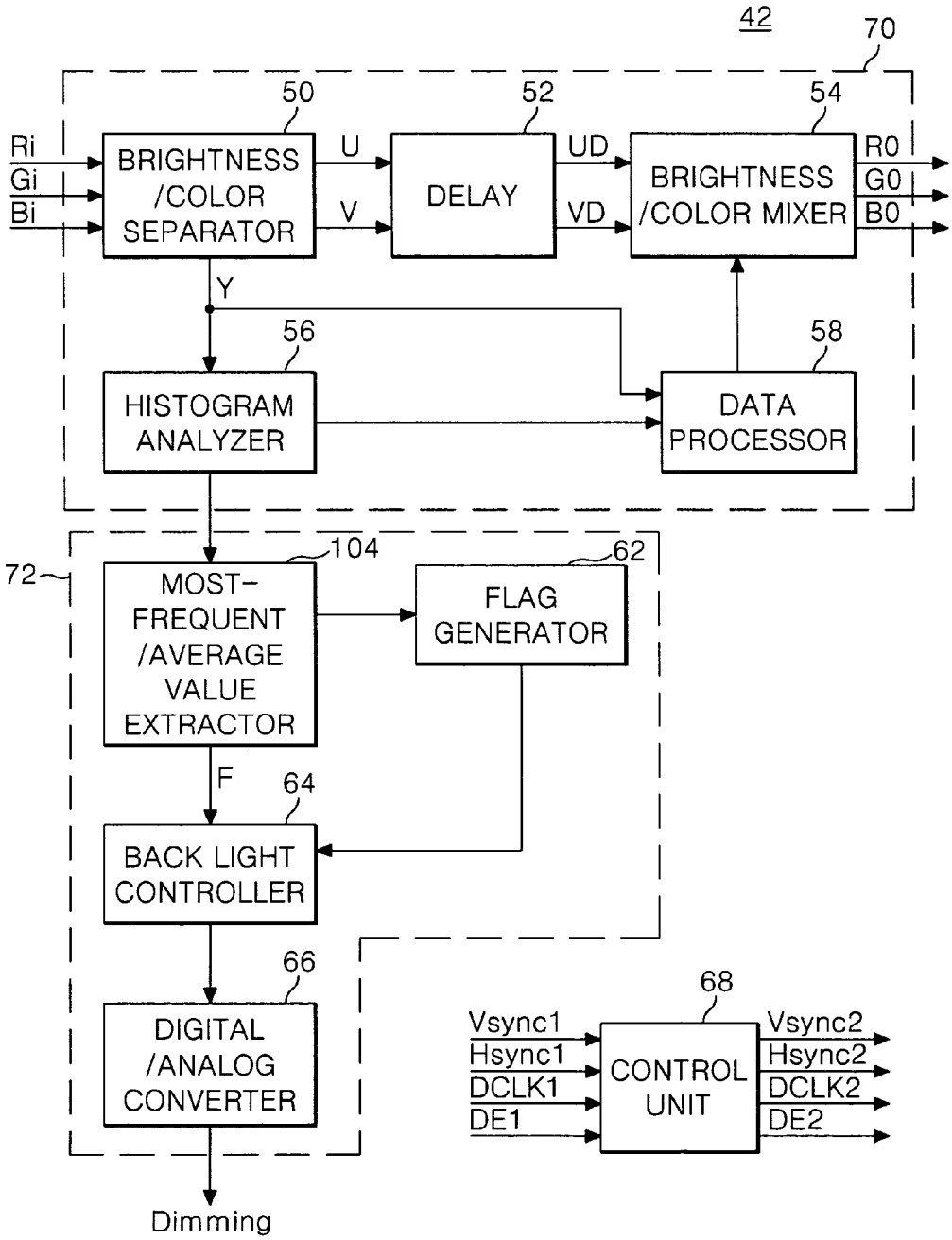
FIG. 10 is a black diagram showing a back light control that includes a most-frequent/average value extractor.

Otherwise, the present-back light control 72 may include a most-frequent/average value extractor 104 as shown in FIG. 10. The most-frequent/average extractor 104 extracts a most-frequent value F and an average value of the analyzed brightness components Y from the histogram analyzer 56. The most-frequent/average extractor 104 having extracted the most-frequent value F calculates a ratio at which a gray level having the most-frequent value F occupies the histogram (i.e., a frequency number of the most-frequent value). Further, the most-frequent/average value extractor 104 applies the most-frequent value F to the flag generator 62 and the back light controller 64 when the ratio that the most-frequent value F occupies is 40% or more of the gray levels of the histogram while applying the average value to the flag generator 62 and the back light controller 64 otherwise.

As mentioned above, the embodiment of the present invention shown in FIG. 10 controls the brightness of the back light 38 using the most-frequent value F when the most-frequent value F is 40% or more of the gray levels of the histogram, thereby displaying a vivid image. On the other hand, the embodiment of the present invention shown in FIG. 10 controls the brightness of the back light 38 using an average value when the most-frequent value F is less than 40% of the histogram, thereby controlling brightness of the back light 38 to correspond to the brightness components Y.

The flag generator 62 and the back light controller 64 generate a brightness control signal using an average value or the most-frequent value F applied thereto. Since a detailed operation procedure of the flag generator 62 and the back light controller 64 has been described with reference to FIG. 6, an explanation as to these elements will be omitted.

As described above, according to the present invention, data is changed into brightness components to be arranged into a histogram for each frame and brightness of the back light is controlled with the aid of a most-frequent value and/or an average value extracted from the histogram, thereby displaying a vivid image. Furthermore, according to the present invention, a plurality of gray level areas having changed brightness components of the back light are established and control is preformed such that the previous brightness is kept at at least one area of these gray level areas, thereby displaying a stable brightness of image.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a display adaptive for making a stable brightness of a back light unit, comprising:

(A) dividing gray levels in a frame to be displayed into a plurality of brightness areas;

(B) converting data of the frame into brightness components;

(C) arranging the brightness components into a histogram of the gray levels;

(D) extracting at least one of a most-frequent value of the gray levels in the histogram and an average value of the gray levels in the histogram;

(E) controlling brightness of a back light to correspond to the brightness areas to which the extracted belongs, wherein the brightness of the back light is controlled such that a different brightness can be produced for each of the brightness areas; and (D) selecting the brightness area to which the most-frequent value belongs to control the brightness of the back light when the number of brightness components occupying the most-frequent value is at least a predetermined percentage of the total brightness components of the frame and selecting the brightness area to which the average value belongs to control the brightness of the back light when the most-frequent value is less than the predetermined percentage.

2. The method of claim 1, wherein the most-frequent value is extracted from the histogram, and the brightness of the back light is controlled to correspond to the brightness area to which the most-frequent value belongs.

3. The method of claim 1, wherein the average value is extracted from the histogram, and the brightness of the back light is controlled to correspond to the brightness area to which the average value belongs.

4. The method of claim 1, wherein the brightness of the back light is controlled such that the brightness supplied increases with an increase in gray level of the extracted value.

5. The method of claim 1, further comprising maintaining the brightness of the back light from the brightness of the back light in a previous frame when the brightness area in which the extracted value belongs is at least one brightness area of the plurality of brightness areas.

6. The method of claim 5, wherein a brightness area of the at least one brightness area separates brightness areas in which the brightness of the back light is allowed to change.

7. A method of driving a display adaptive for making a stable brightness of a back light unit, comprising:

(A) dividing gray levels in a frame to be displayed into a plurality of brightness areas;

(B) converting data of the frame into brightness components;

(C) arranging the brightness components into a histogram of the gray levels;

(D) extracting at least one of a most-frequent value of the gray levels of the histogram and an average value of the gray levels of the histogram;

(E) generating a flag signal to correspond to a brightness area to which the extracted belongs;

(F) controlling brightness of a back fight using the extracted value and the flag signal; and (G) selecting the brightness area to which the most-frequent value belongs to control the brightness of the back light when the number of brightness components occupying the most-frequent value is at least a predetermined percentage of the total brightness components of the frame and selecting the brightness area to which the average value belongs to control the brightness of the back light when the most-frequent value is less than the predetermined percentage.

8. The method of claim 7, further comprising maintaining the flag signal from a previous flag signal when the most-frequent value or the average value belongs to at least one brightness area of the brightness areas and otherwise permitting the flag signal to be able to be changed from the previous flag signal when the most-frequent value or the average value does not belong to the at least one brightness area.

9. The method of claim 8, further comprising maintaining the brightness of the back light from a previous brightness of the back light when the flag signal is maintained irrespective of the brightness area to which the most-frequent value or the average value belongs.

10. The method of claim 8, wherein the at least one brightness area is an area in which a brightness value of the back light is not changed.

11. The method of claim 8, further comprising changing the brightness of the back light to correspond to an area to which the most-frequent value or the average value belongs when the flag signal is changed.

12. A driving apparatus for driving a display adaptive for making a stable brightness of a back light unit, comprising:

a brightness/color separator for converting data of a frame into brightness components;

a histogram analyzer for arranging the brightness components into a histogram of gray levels; and a back light control for extracting a most-frequent value or an average value of the gray levels from the histogram and for controlling brightness of a back light using the extracted value, the back light control dividing the gray levels into a plurality of areas and controlling the brightness of the back light in correspondence with an area to which the extracted value belongs;

wherein the back light control includes:

a most-frequent/average value extractor for extracting the most-frequent value when the number of brightness components occupying the most-frequent value is at least a predetermined percentage of the total brightness components of the frame while extracting the average value when the most-frequent value is less than the predetermined percentage;

a back light controller for controlling the brightness of the back light to correspond to the area to which the extracted value belongs; and a digital to analog converter for converting a digital output signal of the back light controller into an analog output signal to apply the analog output signal to an inverter.

13. The driving apparatus of claims 12, wherein the back light controller controls the back light such that a different brightness of light can be supplied for each area.

14. A driving apparatus for driving a display adaptive for making a stable brightness of a back light unit, comprising:

a brightness/color separator for converting data of a frame into brightness components;

a histogram analyzer for arranging the brightness components into a histogram of gray levels; and a back light control for extracting a most-frequent value or an average value of the gray levels from the histogram and for controlling brightness of a back light using the extracted value, the back light control dividing the gray levels into a plurality of areas and controlling the brightness of the back light in correspondence with an area to which the extracted value belongs;

wherein the back light control includes:

a most-frequent value extractor for extracting the most-frequent value;

a flag generator for generating a flag signal to correspond to the area to which the most-frequent value belongs;

a back light controller that is supplied with the most-frequent value and the flag signal, the back light controller for controlling the brightness of the back light to correspond to the area to which the most-frequent value belongs when the flag signal has been changed in comparison with a previous flag signal; and a digital to analog converter for converting a digital output signal of the back light controller into an analog output signal to apply the analog output signal to an inverter;

wherein the flag generator comprises:

a comparator that compares the most-frequent value with a plurality of gray levels of the histogram and outputs compared results;

a logic array that logically combines the compared results into a plurality of combined results; and a generator that generates the flag signal from the combined results.

15. A driving apparatus for driving a display adaptive for making a stable brightness of a back light unit, comprising:

a brightness/color separator for converting data of a frame into brightness components;

a histogram analyzer for arranging the brightness components into a histogram of gray levels; and a back light control for extracting a most-frequent value or an average value of the gray levels from the histogram and for controlling brightness of a back light using the extracted value, the back light control dividing the gray levels into a plurality of areas and controlling the brightness of the back light in correspondence with an area to which the extracted value belongs;

wherein the back light control includes:

an average value extractor for extracting the average value;

a flag generator for generating a flag signal to correspond to the area to which the average value belongs;

a back light controller that is supplied with the average value and the flag signal, the back light controller for controlling the brightness of the back light to correspond to the area to which the average value belongs when the flag signal has been changed in comparison with a previous flag signal; and a digital to analog converter for converting a digital output signal of the back light controller into an analog output signal to apply the analog output signal to an inverter;

wherein the flag generator comprises:

a comparator that compares the average value with a plurality of gray levels of the histogram and outputs compared results;

a logic array that logically combines the compared results into a plurality of combined results; and a generator that generates the flag signal from the combined results.

16. A driving apparatus for driving a display adaptive for making a stable brightness of a back light unit, comprising:

a brightness/color separator for converting data of a frame into brightness components;

a histogram analyzer for arranging the brightness components into a histogram of gray levels; and a back light control for extracting a most-frequent value or an average value of the gray levels from the histogram and for controlling brightness of a back light using the extracted value, the back light control dividing the gray levels into a plurality of areas and controlling the brightness of the back light in correspondence with an area to which the extracted value belongs;

wherein the back light control includes:

a most-frequent/average value extractor for extracting the most-frequent value when the number of brightness components occupying the most-frequent value is at least a predetermined percentage of the total brightness components of the frame while extracting the average value when the most-frequent value is less than the predetermined percentage;

a flag generator for generating a flag signal to correspond to the area to which the extracted value belongs;

a back light controller that is supplied with the extracted value and the flag signal, the back light controller for controlling the brightness of the back light to correspond to the area to which the extracted value belongs when the flag signal has been changed in comparison with a previous flag signal; and a digital to analog converter for converting a digital output signal of the back light controller into an analog output signal to apply the analog output signal to an inverter.

17. The driving apparatus of claim 14, wherein the back light controller does not change the brightness of the back light when the flag signal has the same value as the previous flag signal.

18. The driving apparatus of claim 15, wherein the back light controller does not change the brightness of the back light when the flag signal has the same value as the previous flag signal.

19. The driving apparatus of claim 16, wherein the back light controller does not change the brightness of the back light when the flag signal has the same value as the previous flag signal.

20. The driving apparatus of claim 14, wherein the flag generator is required to generate a flag signal identical to the previous flag signal when the area to which the most-frequent value belongs is a particular area selected from the plurality of areas.

21. The driving apparatus of claim 15, wherein the flag generator is required to generate a flag signal identical to the previous flag signal when the area to which the average value belongs is a particular area selected from the plurality of areas.

22. The driving apparatus of claim 16, wherein the flag generator is required to generate a flag signal identical to the previous flag signal when the area to which the extracted value belongs is a particular area selected from the plurality of areas.

23. The driving apparatus of claim 20, wherein the particular area lies between areas in which the flag generator is not required to generate a flag signal identical to the previous flag signal.

24. The driving apparatus of claim 21, wherein the particular area lies between areas in which the flag generator is not required to generate a flag signal identical to the previous flag signal.

25. The driving apparatus of claim 22, wherein the particular area lies between areas in which the flag generator is not required to generate a flag signal identical to the previous flag signal.

26. The driving apparatus of claim 16, wherein the flag generator comprises:

a comparator that compares the extracted average value with a plurality of gray levels of the histogram and outputs compared results;

a logic array that logically combines the compared results into a plurality of combined results; and a generator that generates the flag signal from the combined results.

* * * * *